US005524596A

United States Patent [19]

Nakai et al.

[11] Patent Number: 5,524,596

[45] Date of Patent: Jun. 11, 1996

[54] MOUNTING ARRANGEMENT FOR ENGINE COMPONENTS OF AN OUTBOARD MOTOR

[75] Inventors: Hiroshi Nakai; Akihiko Hoshiba; Yasuhiko Shibata, all of Hamamatsu, Japan

[73] Assignee: Sanshin Kogyo Kabushiki Kaisha, Shizuoka-ken, Japan

[21] Appl. No.: 302,217

[22] Filed: Sep. 8, 1994

[30] Foreign Application Priority Data

Sep. 8, 1993 [JP] Japan ..... 5-246093

[51] Int. Cl.[6] ..... F02B 13/00

[52] U.S. Cl. ..... 123/583; 123/196 W

[58] Field of Search ..... 123/583, 580, 123/336, 579, 196 W

[56] References Cited

U.S. PATENT DOCUMENTS 5,036,805 8/1991 Yamamoto et al. ..... 123/579
5,088,468 2/1992 Imaeda ..... 123/583
5,326,293 7/1994 Shishido et al. ..... 123/579
5,367,998 11/1994 Shiohara et al. ..... 123/583

FOREIGN PATENT DOCUMENTS 3-21551 3/1991 Japan .

*Primary Examiner*—Erick R. Solis
*Attorney, Agent, or Firm*—Knobbe, Martens, Olson & Bear

[57] ABSTRACT

A mounting arrangement for an accelerator pump and a choke actuation mechanism, which are used in conjunction with a plurality of charge formers, minimizes the girth of the engine while making these components more accessible and easing assembly. An actuator and a choke solenoid of the choke actuation system are mounted proximate to one another and partially between adjacent induction pipes of an induction system. This position allows these components to be located on an exterior side of the induction system without interfering with the protective cowling of the motor. The accelerator pump is mounted at the end of a series of charge formers, proximate to a throttle linkage which controls throttling devices of the charge formers. This position of the accelerator pump eases the installation of this component without increasing the girth of the engine.

13 Claims, 7 Drawing Sheets

MOUNTING ARRANGEMENT FOR ENGINE COMPONENTS OF AN OUTBOARD MOTOR

BACKGROUND OF THE INVENTION

1. Field of the Invention

This invention relates to an engine for an outboard motor and more particularly to an improved mounting arrangement for engine components of an outboard motor.

2. Description of Related Art

A conventional outboard motor includes a plurality of charge formers. Typically, the charge formers are positioned above one another on one side of the engine, and between an intake manifold and an induction system of the engine.

The engine also commonly includes an accelerator pump and a choke solenoid which work in combination with the charge formers of the engine. The accelerator pump adds additional fuel to the charge formers during rapid or full throttle acceleration of the engine. The choke solenoid closes the choke valves of the charge formers when starting the engine from a cold start.

In the prior engine layouts, the accelerator pump is fixed to the intake manifold, and the choke solenoid is fixed to the engine by a bracket located near the charge formers. The choke solenoid commonly is attached to the engine after the charge formers have been mounted to the engine. An example of such prior mounting arrangement is disclosed in Japanese Utility Patent Publication 3-21551.

With the prior mounting arrangement of the accelerator pump and the choke solenoid, assembly is difficult and time consuming. The assembly process is complicated because the choke solenoid must be attached to the engine after the charge formers and the accelerator pump have been attached to the intake manifold. Thus, the charge formers must first be assembled, aligned and connected to the inlet pipes of the intake manifold, and then be mounted to the engine. The accelerator pump is mounted to the intake manifold, and the choke solenoid thereafter is attached between the charge formers and the cylinder block of the engine. The act of attaching the choke solenoid between the charge formers and the cylinder block is a complicated, difficult and time-consuming process.

Although it has been appreciated that the choke solenoid can be fixed to the intake manifold, this location would increase the size or girth of the engine, and would complicate the linkage between the solenoid and the choke valves. The size of the protective cowling surrounding the engine of the outboard motor consequently would increase. The larger sized cowling would disadvantageously produce more drag on the watercraft and would increase the overall weight of the watercraft which the motor must propel through the water.

SUMMARY OF THE INVENTION

A need therefore exists for a mounting arrangement for a choke operating system and an accelerator pump for an outboard motor which simplifies mounting of the choke solenoid and the accelerator pump to the engine. The system also desirably minimizes the time and difficulty involved with connecting these components to the engine.

In accordance with an aspect of the present invention, an engine includes a plurality of induction pipes which communicates with a plurality of charge formers. The engine also includes a first device for the closing choke devices of the charge formers. A first support is attached to the charge formers and supports the first device proximate to the choke devices of the charge formers.

BRIEF DESCRIPTION OF THE DRAWINGS

These and other features of the invention will now be described with reference to the drawings of a preferred embodiment which is intended to illustrate and not to limit the invention and in which.

DETAILED DESCRIPTION OF THE PREFERRED EMBODIMENT

Figure 1:
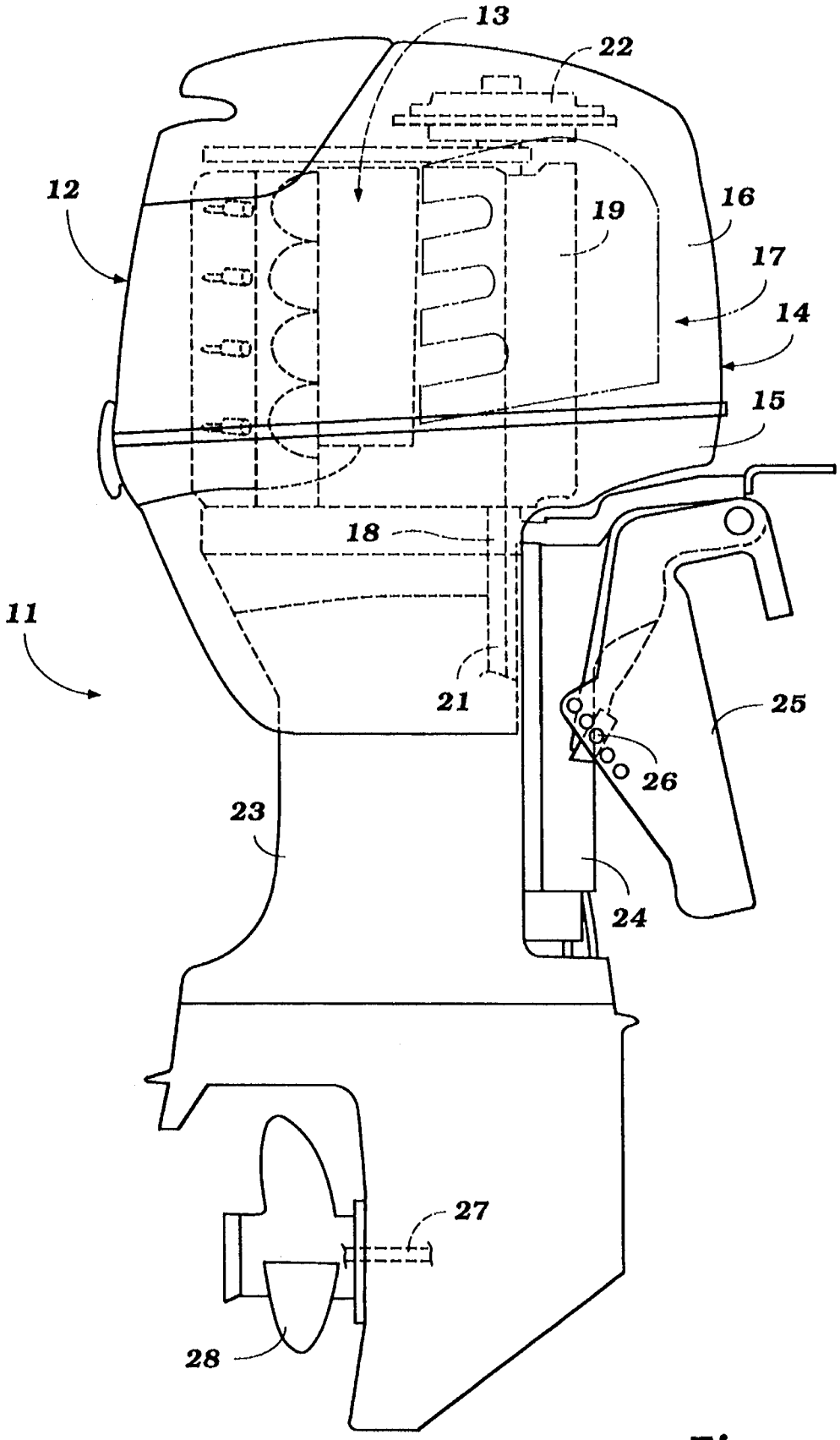
FIG. 1 is a side elevational view of an outboard motor configured in accordance with a preferred embodiment of the present invention.

FIG. 1 illustrates a marine outboard drive 11 which incorporates an engine component mounting system configured in accordance with a preferred embodiment of the present invention. Although it is understood that the present engine component mounting system can be incorporated into any type of engine, the present invention is particularly well-suited for a vertically oriented engine of a marine outboard drive. It is contemplated, however, that certain aspects of the invention can be employed with an inboard/outboard motor as well.

The outboard motor 11 includes a power head, indicated generally by the reference numeral 12. The power head 12 desirably includes an internal combustion engine 13 which is surrounded by a protective cowling 14. The protective cowling is formed by a lower tray 15 and an upper cowling member 16. These elements of the protective cowling 15 together define an engine compartment 17 which houses the engine 13.

The internal combustion engine 13 in the illustrated embodiment is a four-cycle, in-line, four-cylinder combustion engine. It is understood, however, that the present invention can be employed with engines having other numbers of cylinders, cylinder orientations, and/or operating on other than a four-stroke principle.

The engine 13 is conventionally mounted with a crankshaft 18 rotating about a generally vertical axis. The crankshaft 18 is suitably journaled for rotation within a crankcase 19 and drives a drive shaft 21, which is attached to the crankshaft 18 in a known manner. A standard magneto generator/flywheel assembly 22 is attached to the upper end of the crankshaft 18.

The drive shaft 21 extends into a drive shaft housing 23 which depends from the lower tray 15. A steering bracket 24 is attached to the drive shaft housing 23 in a conventional manner. The steering bracket 24 is pivotably connected to a clamping bracket 25 by a pin 26. The clamping bracket 25, in turn, is configured to be attached to a transom (not shown) of the watercraft. This conventional coupling permits the outboard motor 11 to be pivoted relative to the steering bracket 24 for steering purposes, as well as to be pivoted relative to the pin 26 to permit adjustment to the trim position of the outboard motor 11 and for tilt up of the outboard motor 11. It will be readily understood that a conventional hydraulic tilt and trim cylinder assembly, as well as a conventional hydraulic steering cylinder assembly could be used as well with the present outboard motor to assist steering and trim adjustment operations.

As schematically illustrated in FIG. 1, the drive shaft 21 extends into the drive shaft housing 23. A transmission (not shown) selectively couples the drive shaft 21 to a propulsion shaft 27. The transmission desirably is a forward/neutral/reverse-type transmission. In this manner, the drive shaft 21 rotationally drives the propulsion shaft 27 in a selected forward or reverse direction.

The propulsion shaft 27 drives a propulsion device, such as, for example, a propeller 28. In the illustrated embodiment, the propulsion device is a single propeller; however, it is understood that a counter-rotational propeller device could be used as well. It is understood that the construction of the outboard motor 11 thus far described is considered conventional, and further details of the outboard motor are not believed to be necessary for an understanding of the construction and operation of the present invention.

Figure 2:
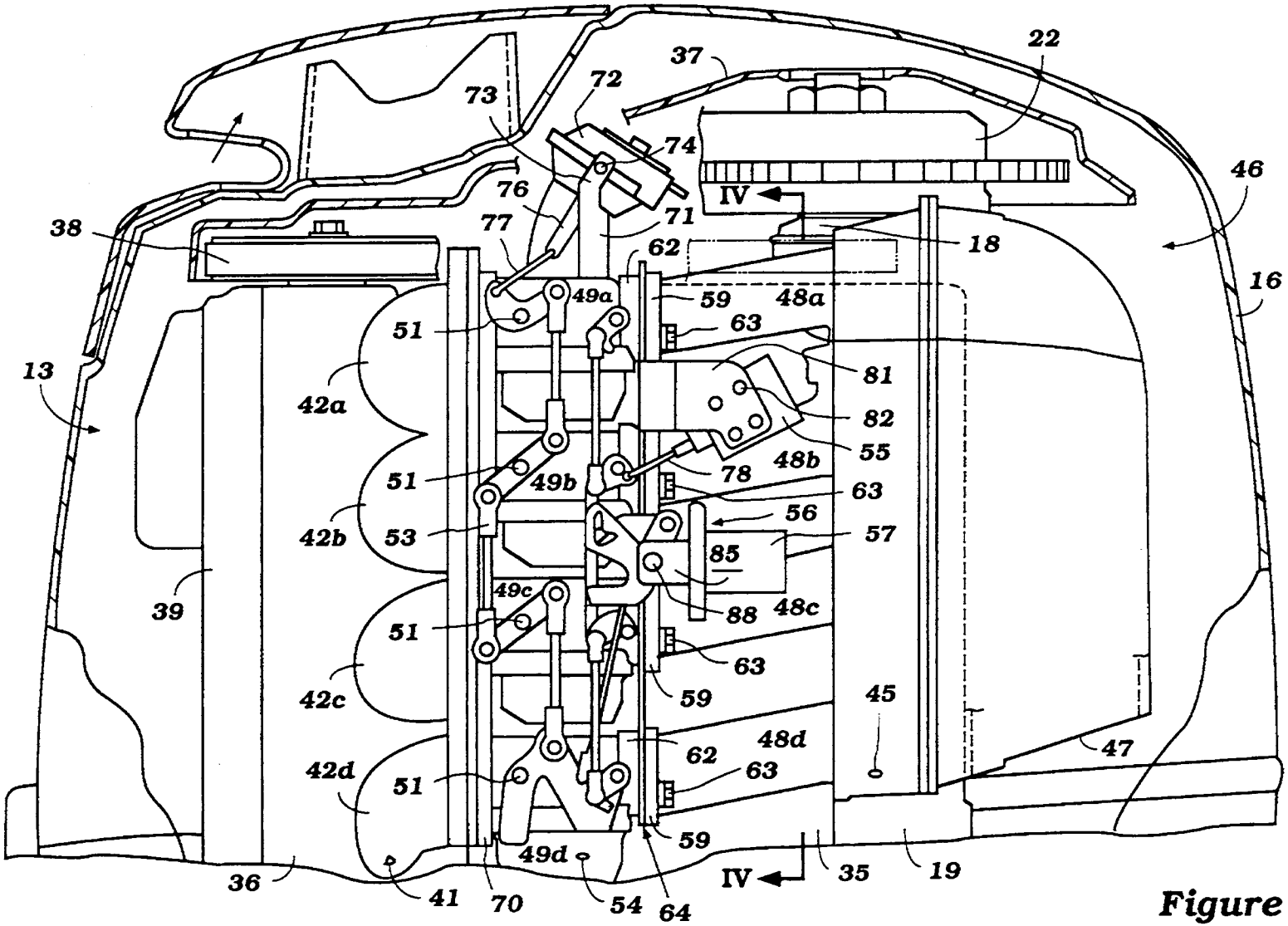
FIG. 2 is a partial enlarged, cut-away side elevational view of a power head of the outboard motor of FIG. 1.

With reference to FIG. 2, the engine 13 of the outboard motor 11 includes a cylinder block 35 which defines four cylinder bores (not shown) that have their axes lying on different horizontal planes, yet lying within a common vertical plane. Pistons (not shown) reciprocate within the cylinder bores, in a known manner, and are connected to the crankshaft 18 by connecting rods (not shown) which link the pistons and the crankshaft 18 together in a known manner so that the linear reciprocal movement of the pistons is translated to rotational movement of the crankshaft 18. The crankcase 19, attached to the cylinder block 35 by known means, surrounds at least a portion of the crankshaft 18 with the crankshaft 18 journaled therein.

A cylinder head 36 of conventional construction is attached to an end of the cylinder block 35 opposite from the crankcase 19. The cylinder head 36 supports and houses an intake and exhaust valve system (not shown).

A cam cover 39 is attached to the cylinder head 36 on a side of the cylinder head 36 opposite the cylinder block 35. The cam cover 39 and the cylinder head 35 together define a cam chamber in which a conventional valve operation mechanism is journaled. In the illustrated embodiment, the engine 13 includes an overhead camshaft (not shown) which operates the overhead intake and exhaust valve system. The crankshaft 18 drives the overhead camshaft via an external toothed timing belt 38. Because the invention deals primarily with the support and arrangement of induction system components of the engine 13, it is not believed necessary to discuss or describe in greater detail the particular valve system and valve operation mechanism of the engine 13.

Figure 3:
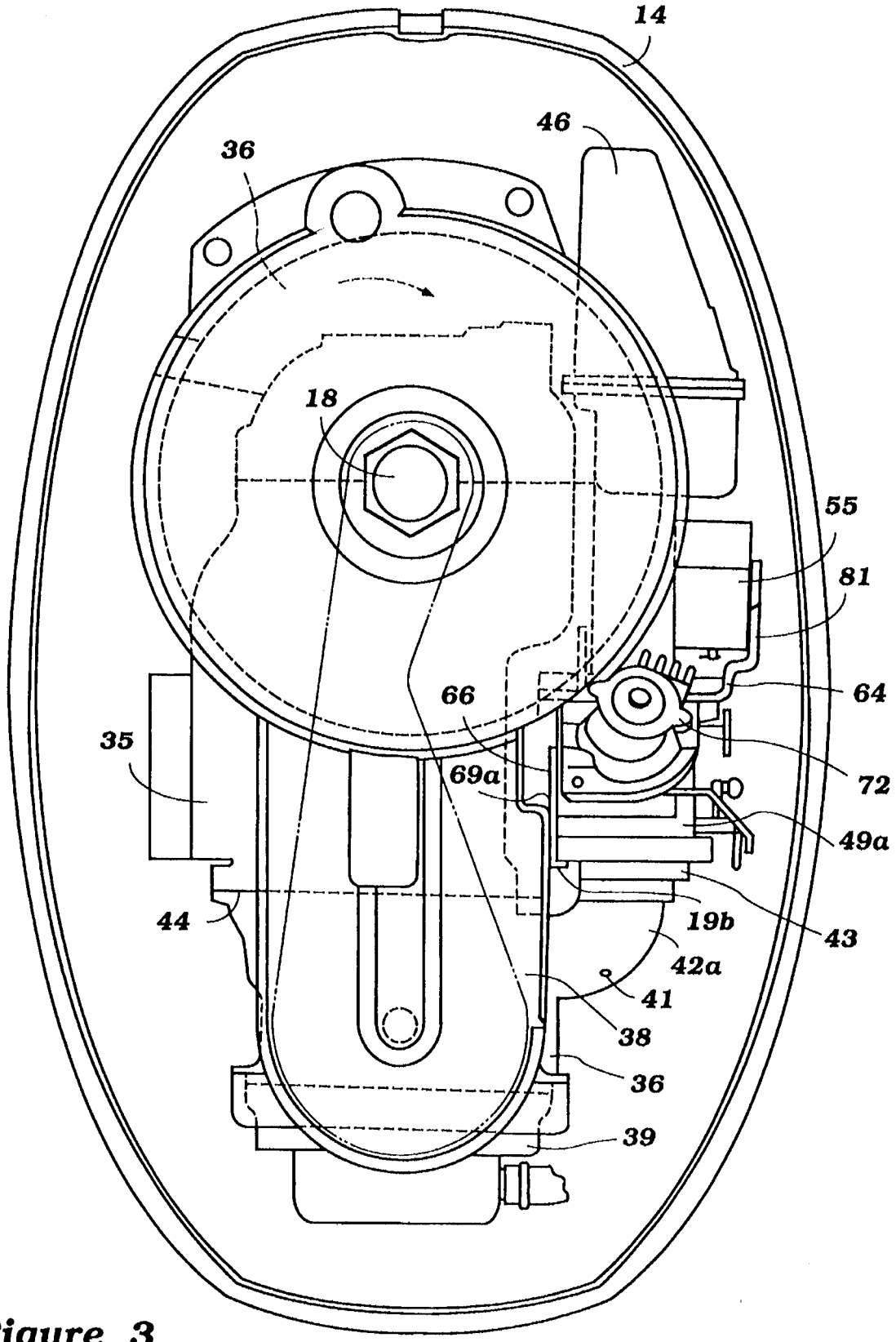
FIG. 3 is a top plan view of the power head of FIG. 2 with a top cowling of the power head removed to expose an engine.

As best seen in FIGS. 2 and 3, the cylinder head 36 includes an integral intake manifold 41 having a plurality of intake pipes 42. For ease of description, each intake pipe will be designated by an "a," "b," "c," or "d" suffix, designated from the top down, and the intake pipes in general will be identified by reference numeral 42, without suffix. Each intake pipe 42 communicates with an individual combustion chamber of the engine 13 through the intake valve system. As best seen in FIG. 3, the intake manifold 41 integrally extends from the cylinder head 36 on the induction side of the engine 13, and terminates in a flange 43 that extends generally parallel to a sealing surface 44 of the cylinder head 36.

With reference to FIG. 3, an induction system 45 of the engine 13 supplies a fuel/air charge to the individual combustion chambers through the intake manifold 41. The induction system 45 includes an intake silencer 46 having a downwardly facing air inlet opening 47 which is disposed to the front of the power head 12 and on one side of the crankcase 19. The intake silencer 46 draws air into the engine 13 from the interior of the cowling 18 and silences the intake air charge.

The induction system 45 supplies air to a plurality of induction pipes 48, which deliver the air flow from the intake silencer 46 to a plurality of charge formers 49. The lengths of the induction pipes 48 are preferably tuned with the intake silencer 46 to minimize the noise produced by the induction system 45, as known in the art.

In the illustrated embodiment, the charge formers 49 are a plurality of carburetors positioned along a vertical axis. That is, the carburetors 49 are positioned above one another, stacked in a direction generally parallel to the vertical axis. It should be understood, however, that although the present mounting arrangement for the engine components is described in conjunction with a carbureted engine, certain facets of the invention may be employed in conjunction with other types of charge formers, such as fuel injectors or the like. For ease of description, each carburetor will be designated by an "a," "b," "c," or "d" suffix, identified, from the top down, and the carburetors in general shall be designated by reference numeral 49, without suffix.

Figure 5:
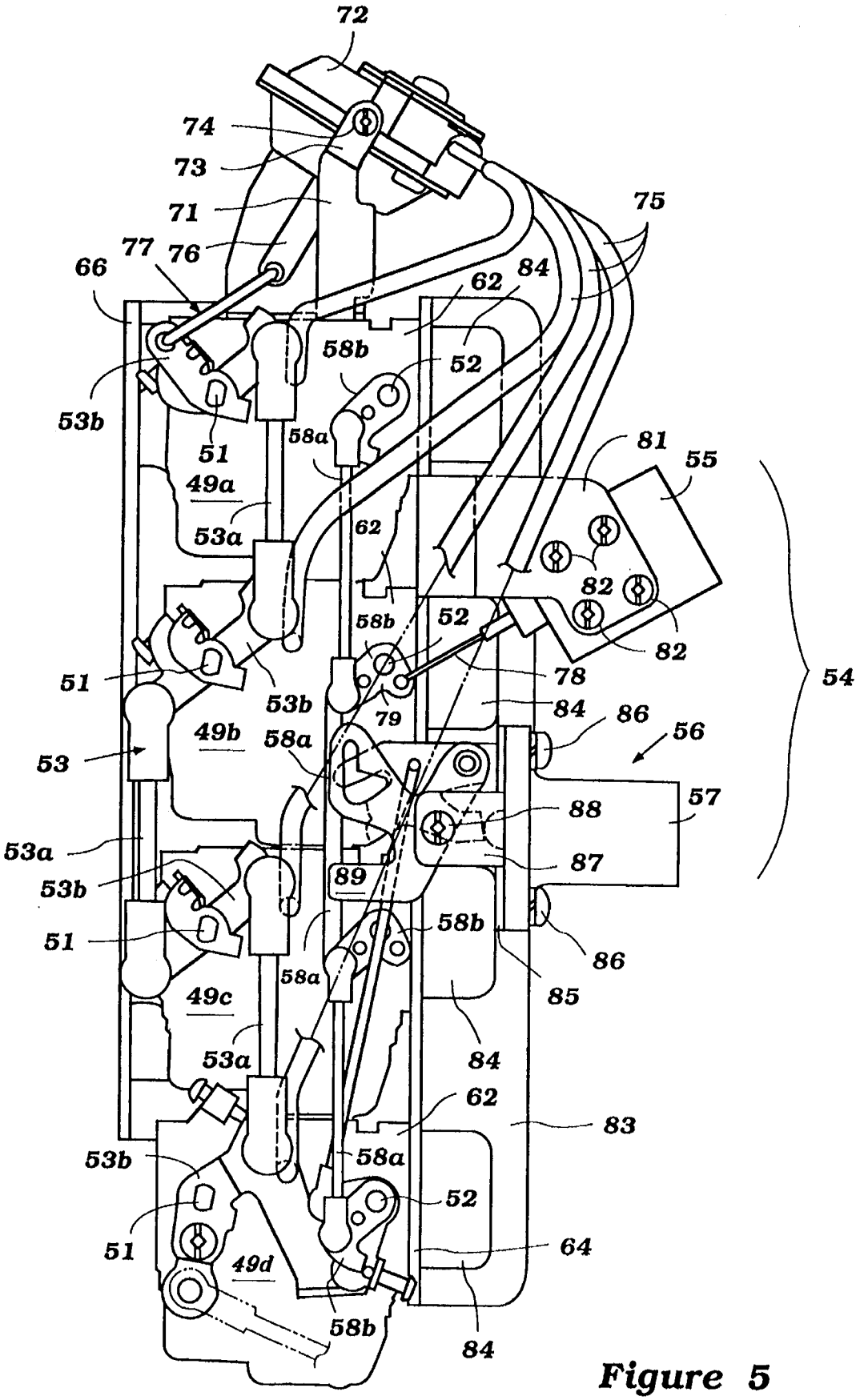
FIG. 5 is a side elevational view of a charge former assembly of the power head of FIG. 2.

The carburetors 49 may be of any known type and construction. In the illustrated embodiment, as best seen in FIG. 5 which depicts carburetors 49 generally isolated from the balance of the induction system 45, each carburetor 49 includes a throttle valve (not shown) operated by a throttle shaft 51, and a choke valve (not shown) operated by a choke shaft 52. A throttle linkage 53 connects the throttle shafts 51 of the carburetors 49 together to synchronize operation of the throttle valves. A suitable throttle linkage 53, comprising a series of links **53*a* and connecting arms 53*b***, is disclosed in U.S. patent application, Ser. No. (unknown) (attorney docket No. SANSH2.590A), filed Sep. 8, 1994, in the names of Sadato Yoshida, Hiroshi Nakai, Akihiko Hoshiba, and Yasuhiko Shibata, and assigned to the assignee hereof, which is hereby incorporated by reference.

With reference to FIGS. 2 and 5, a choke actuation system 54 controls the operation of the choke shafts 52. A suitable choke actuation system 54 is disclosed in U.S. patent application, Ser. No. (unknown) (attorney docket No. SANSH2.657A), filed Sep. 8, 1994, in the name of Akihiko Hoshiba and assigned to the assignee hereof, which is hereby incorporated by reference. As best seen in FIG. 5, the choke actuation system 54 includes a solenoid 55 which controls the movement of the choke valves and a choke control mechanism 56 which limits the extent to which the solenoid 55 can close the choke valves and gradually opens the choke valves as the engine 13 warms from a cold start. The choke control mechanism 56 includes an actuator 57 with a positive temperature coefficient (PCT) device for this latter purpose. The choke actuation system 54 also includes a choke linkage 58 which connects the choke shafts 52 of the carburetors 49 to the choke control mechanism 56 and to the choke solenoid 55. The choke linkage 58 includes a series of links 58*a* and arms 58*b* to uniformly move the choke shafts 52 of the carburetors 49.

The solenoid 55 is linked to the choke valves of the carburetors 49 by a rod 78 that extends from solenoid 55 to a choke lever 79 of the choke linkage 58. The choke lever 79 is fixed to the choke shaft 52 such that rotation of the choke lever 79 rotates the choke shaft 52, and moves the entire choke linkage 58.

Figure 4:
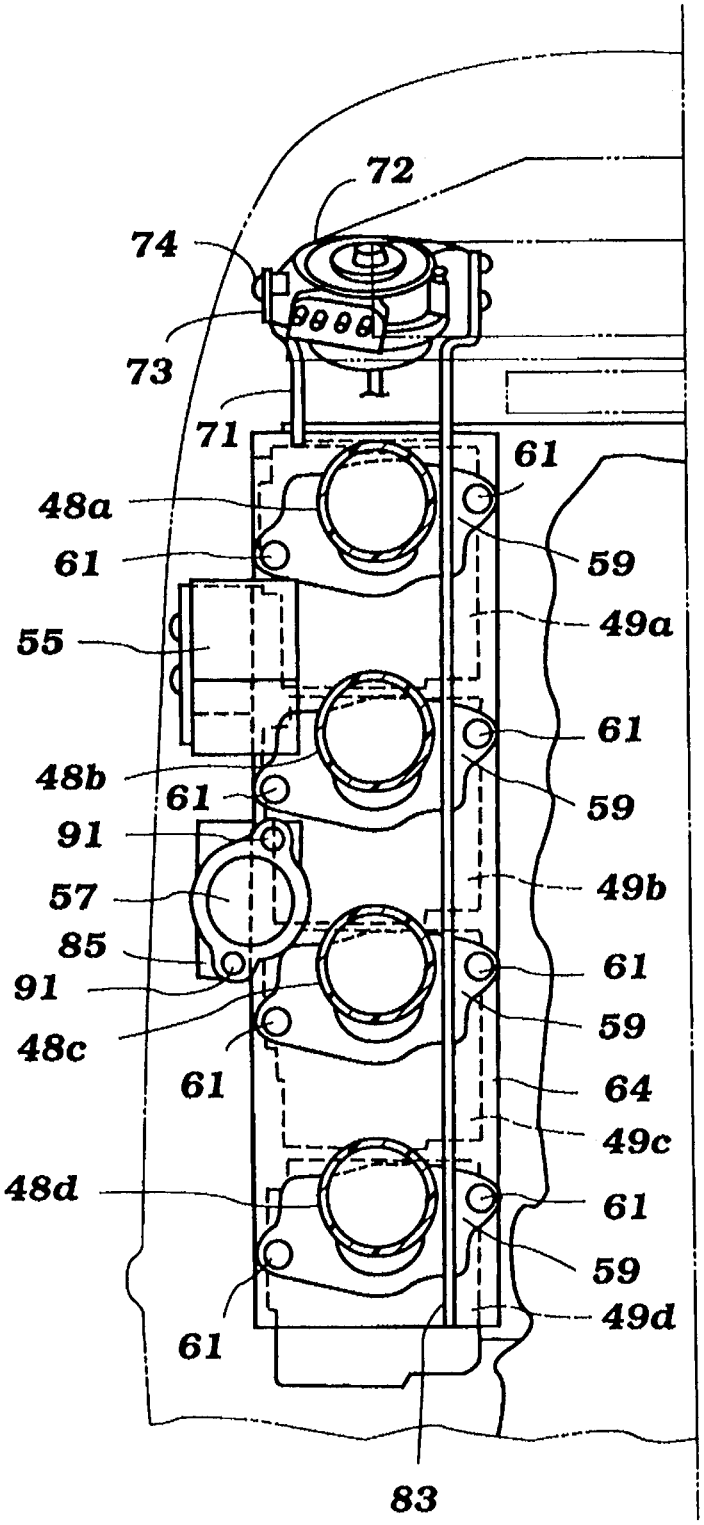
FIG. 4 is a partial cross-sectional view taken through a series of inlet pipes of an induction system of the power head of FIG. 2, taken along line 4–4.

With reference to FIG. 2, the inlet sides of the carburetors 49 (i.e., the side proximate to the intake silencer 46) are mounted to the outlet ends of the induction pipes 48. For this purpose, as best seen in FIG. 4, each induction pipe 48 includes a mounting flange 59. Each mounting flange 59 includes a pair of mounting holes 61 which cooperate with corresponding mounting holes formed in an inlet end flange 62 of the carburetor 49. As seen in FIG. 2, bolts 63 pass through the mounting holes 61 of the induction pipe flanges 59 and the carburetor inlet end flanges 62 to secure the induction pipes 48 and carburetors 49 together, as discussed in detail below. As discussed in detail in U.S. patent application, Ser. No. (unknown) (attorney docket No. SANSH2.589A), filed Sep. 8, 1994, in the names of Sadato Yoshida, Hiroshi Nakai, Akihiko Hoshiba, and Yasuhiko Shibata, and assigned to the assignee hereof, which is hereby incorporated by reference, the bolts 63 also can extend through the carburetor body 49, pass through mounting holes in a carburetor outlet end flange (not shown) and thread into mounting holes of the mounting flanges (not shown) of an insulator assembly 70. The insulator assembly 70 in turn is attached to the flange 43 of the intake manifold 41. The insulator assembly 70 thermally separates the carburetors 49 from the engine 13. The bolts 63 thus secure the carburetors 49 between the induction pipe flanges 59 and the intake manifold flange 41 to generally seal the induction pathways between these components.

As best seen in FIGS. 2 and 4, a first support plate 64 is interposed between the carburetor inlet flanges 62 and the induction pipe flanges 59. The support plate 64 aligns with and allows interconnection of the induction pipes 48 and the carburetors 49.

The first support plate 64 includes a plurality of spaced openings 65 which correspond to the inlet openings of the carburetors 49 and the outlet of the induction pipes 48 to allow fluid communication between the induction pipes 48 and the carburetors 49. The first support plate 64 desirably includes a plurality of apertures (not shown) adapted to allow the bolts 63 to pass through the support plate 64.

Figure 6:
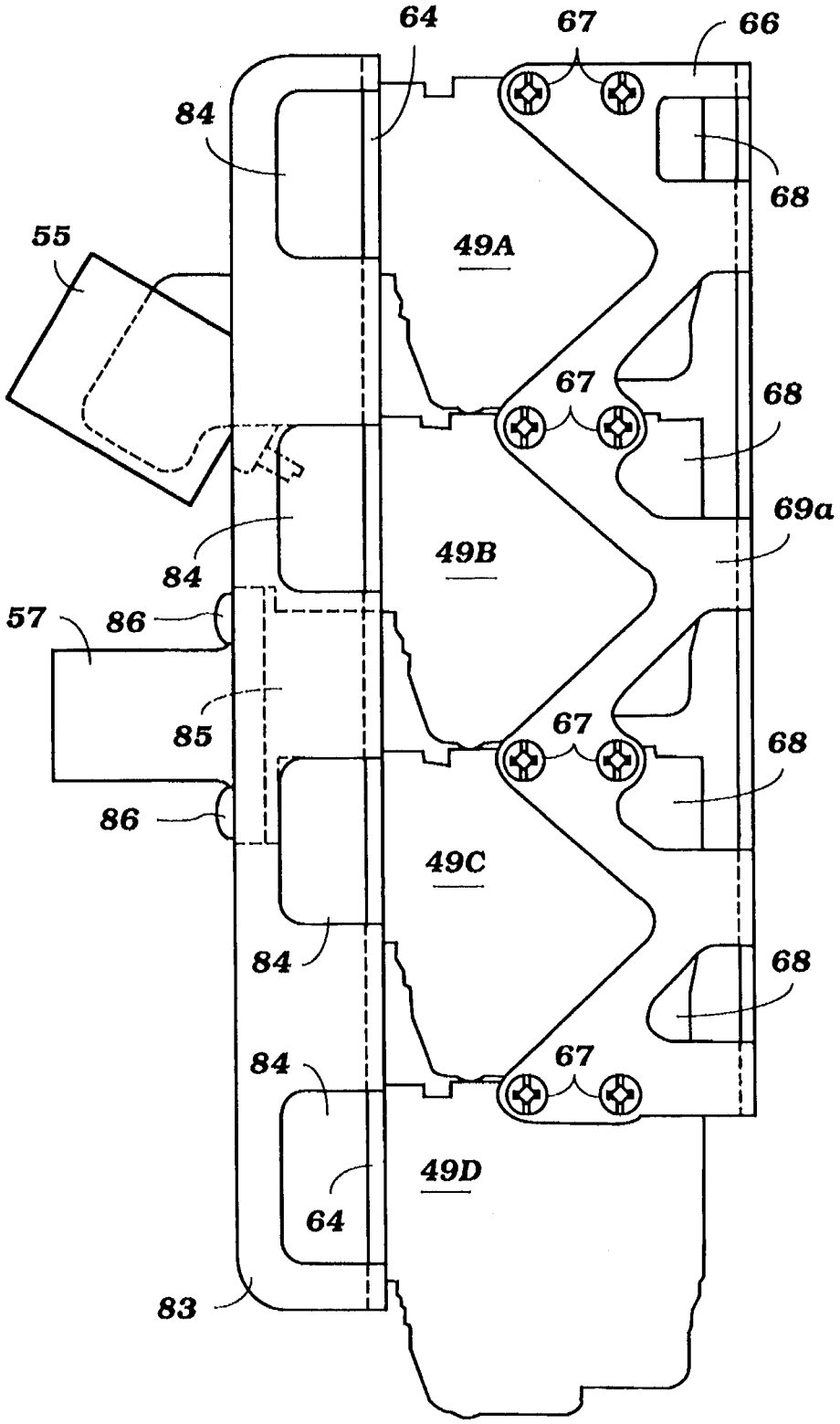
FIG. 6 is an opposite side elevational view of the charge former assembly of FIG. 5.

With reference to FIGS. 4 and 6, the support plate 64 includes a longitudinal rib 83 that extends generally perpendicularly to the planar body of the plate 64. As best seen in FIG. 6, the rib 83 defines an opening 84 proximate to each carburetor 49. The openings are adapted to receive a portion of the mounting flange 59 of the induction pipe 48 when mounting of the pipes 48 to the plate 64. The rib 83 desirably is sized to increase the stiffness and rigidity of the plate 64.

Figure 7:
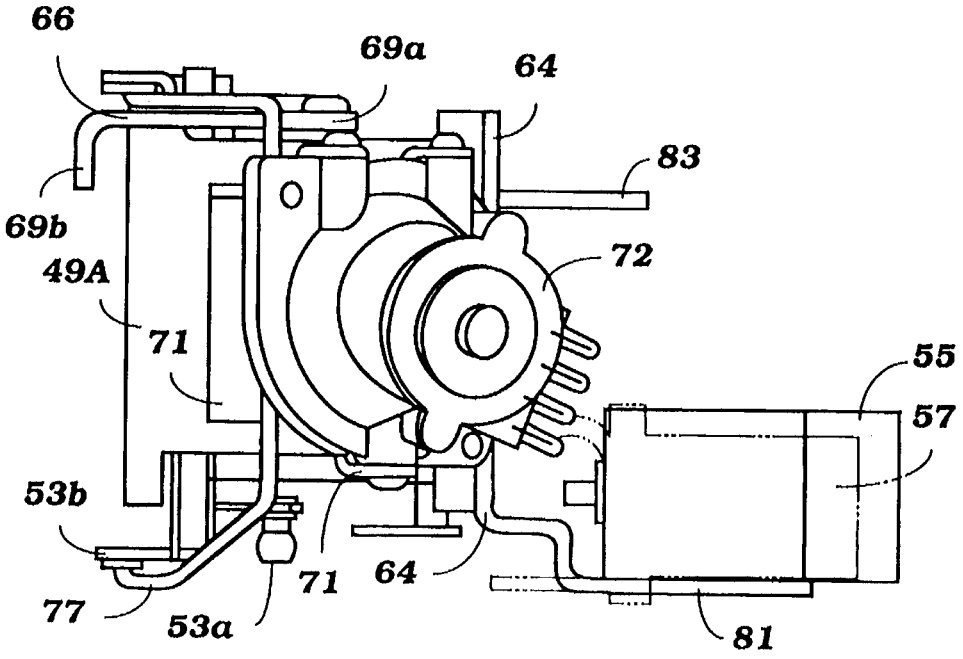
FIG. 7 is a top plan view of the charge former assembly of FIG. 5.

The first mounting plate 64 also includes several projecting bracket arms which support the actuator 57 and the solenoid 55 of the choke actuation system 54. A first bracket arm 81 extends from an outer edge (i.e., an edge distal of the cylinder block 35 in assembly) toward the intake silencer 46. The first bracket arm 81 is positioned proximate to the second opening in the first plate 64 for the second carburetor 49*b* so as to position the solenoid 55 proximate to the choke shaft 52 of the second carburetor 49*b*. Screws 82 desirably fasten the solenoid 55 to the first bracket arm 81 in this position. As best seen in FIGS. 3 and 7, the bracket arm 81 can be integrally formed as an extension of the first support plate 64. Alternatively, the bracket arm 81 may be securely fastened to the support plate 64.

Figure 8:
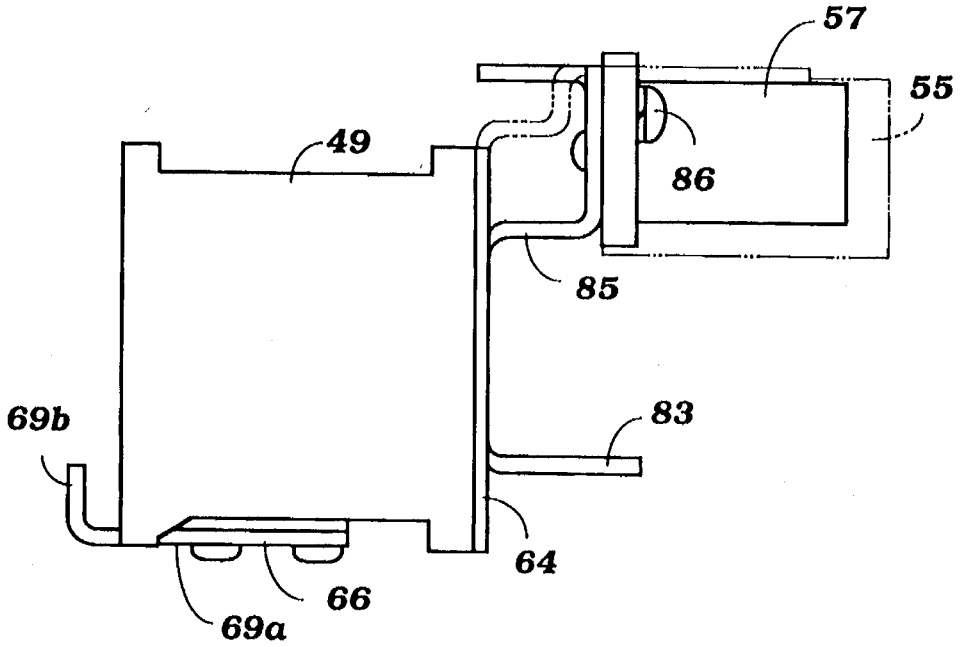
FIG. 8 is a bottom plan view of the charge former assembly of FIG. 5.

The first mounting plate 64 also includes a second bracket arm 85. The second bracket arm 85 extends from the outer edge of the support plate 64 towards the intake silencer 46, and forms a mounting surface which lies generally parallel to the first mounting plate 64, as best seen in FIG. 8. Bolts 86 secure the actuator 57 to the mounting surface of the bracket 85. As best seen in FIGS. 4 and 8, the bracket 85 is preferably integrally formed with the first support plate 64. Alternatively, the bracket 85 may be fastened to the first support plate 64. The bracket 85 also includes an extension 87 which projects from the end of the support surface of the bracket 85 towards the carburetors 49. A bolt 88 passes through an aperture in the extension 87 to fix a portion of a cam assembly of the choke control device 56 to the second bracket 85.

With reference to FIG. 6, a second support plate 66 is releasably fixed to the outlet sides of the carburetors 49. The second support plate 66 is formed by a first leg 69*a* and a second leg 69*b*. The first leg 69*a* has a longer length than the second leg 69*b* to form, in cross-section, an L-shaped member. The first leg 69*a* includes a plurality of V-shaped recesses that extend into the leg 69*a*. Mounting holes located at the apexes of corresponding V-shape projections allow screws 67 to secure the first leg 69*a* to the back side of the carburetors 49 (i.e., the side of the carburetors 49 adjacent to the cylinder block 35). In this manner, the support plate 66 maintains the spacings between the carburetors 49.

The position of the support plate 66 relative to the engine 13 is best seen in FIG. 3. The first leg 69*a* extends parallel to the cylinder block 35 and has a sufficient length to position the second leg 69*b* so as to engage the rear side of the insulator assembly 70. The second leg 69*b* desirably is sized to stiffen the second support plate 66 along its longitudinal direction. The second leg 69*b* also is sized to fit within the space defined between the cylinder block 35, intake manifold 41 and end of the insulator assembly 70.

With reference to FIG. 2, a bracket 71 supports a diaphragm-type accelerator pump 72 near the upper carburetor 49*a*. The accelerator pump 72 injects fuel into the throttle passages of the carburetors 49 during rapid or full throttle acceleration of the engine 13. The acceleration pump 72 is connected to the fuel supply system (not shown) of the engine 13 which provides fuel to the pump 72 for its charging upon closing of the throttle valves of the carburetors 49. A plurality of fuel lines 75, illustrated in FIG. 5, allows the accelerator pump 72 to provide fuel directly to the individual carburetors 49 at any desired located in their induction passages, for example, proximate to their venturi sections. This fuel may be drawn from the fuel bowl of one or more of the carburetors 49.

The pump 72 is operated by an actuator 76 that extends from the accelerator pump 72 and is connected by a link 77 to the throttle linkage 53. Specifically, the link 77 comprises a U-shaped member that is attached to an arm 53*b* of the throttle linkage 53 and the second support plate 66. The interconnection between the actuator 76, link 77 and throttle linkage 53 allows the operation of the pump 72 to be controlled by the throttle position of the engine 13.

Operation of the throttle linkage 53 in a manner opening the throttle valves causes the link 77 to move upward, thereby moving the actuator 76 in a like direction. The upward movement of the actuator 76 operates the accelerator pump 72, which in turn squirts a finite amount of fuel into the carburetors 49 during rapid or full throttle acceleration of the engine 13.

The bracket 71 preferably includes an angled section 73 to secure the pump 72 at an angle relative to the vertical axis of the engine 13. The pump 72 is preferably releasably secured to the angled section 73 of the bracket 71 by fasteners 74. As seen in FIG. 4, the bracket 71 preferably has a "U" shape that receives the pump 72 between its two vertical legs. The bracket 71 and pump 72 are centered above the carburetors 49 and attached to the upper carburetor 49*a*.

As best seen in FIG. 4, the accelerator pump 72, actuator 57 and solenoid 59 are located proximate to the carburetors 49. Specifically, the accelerator pump 72 is located above the upper carburetor 49*a* and is centered above the carburetors 42. This position advantageously allows the accelerator pump 72 to be located proximate the carburetors 42 and directly connected to the throttle linkage 53. In addition, in this position gravity assists fuel delivery from the accelerator pump 72 to the carburetors 49.

The actuator 57 is positioned in a space defined by the protective cowling 14 and a recess formed between two adjacent induction pipes 48, preferably the second and third induction pipes 48*b*, 48*c*. The solenoid 55 similarly is located in the recess between two adjacent induction pipes 48, preferably the first and second induction pipes 48*a*, 48*b*, of the induction system 45. This location advantageously positions the solenoid 55 and the actuator 57 in close proximity to each other and to the choke linkage 58. The position also minimizes the extent to which the solenoid 55 and actuator 57 project beyond an external edge of the induction system, thereby minimizing the engine girth. In this position, these components also can be quickly and easily mounted to the bracket arms 81 and 85, respectively, which extend from the support plate 64, rather than being connected to the intake manifold 41 or behind the carburetors 49. As such, these components advantageously are located on the exterior surface of the induction system 45 to allow easy access, installation and removal of the choke operating system 54, and these locations do not interfere with the protective cowling 14 of the engine 13.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. An engine comprising a cylinder block, a cylinder head connected to said cylinder block, an intake manifold having a plurality of runners, each runner connected to a charge former, a plurality of induction pipes communicating with said charge formers and extending along a side of said engine block, and a first device for closing choke devices of said charge formers, said engine further comprising a first support attached to said charge formers and supporting said first device proximate to said choke devices of said charge formers on a side of said induction pipes opposite of said engine block.

2. The engine of claim 1, wherein said first support is interposed between said charge formers and said induction pipes.

3. The engine of claim 1, wherein at least two induction pipes define a first recess and said first support is configured so as to position at least a portion of said first device within said first recess between said induction pipes.

4. The engine of claim 3 additionally comprising a second device for controlling the extent to which said first device can close said choke devices, said first support supporting said second device such that a least a portion of said second device is positioned within a second recess defined between two induction pipes.

5. The engine of claim 4, wherein the positions of said first device and said second device on said first support correspond with adjacent recesses formed between said induction pipes.

6. The engine of claim 4 additionally comprising a protective cowling which surrounds at least said induction pipes, said first device being positioned within a first space defined between said cowling and said first recess, and said second device being positioned with a second space defined between said cowling and said second recess.

7. The engine of claim 4, wherein said first support comprises a plate having a first arm which generally extends perpendicular to said plate, said first device being attached to said first arm, and a second arm which generally extends perpendicular to said plate and supports said second device.

8. The engine of claim 7, wherein said support additionally comprises a stiffening rib which extends along a portion of a longitudinal length of said plate, said rib including a plurality of recesses, each recess sized to receive a portion of one of said induction pipes.

9. The engine of claim 1 additionally comprising a second support, said charge formers being coupled to said second support so that said second support maintains spacings between said charge formers.

10. The engine of claim 9, wherein said charge formers are fixed to said second support.

11. The engine of claim 9, wherein said second support is configured to couple with said runners of said intake manifold.

12. The engine of claim 9 additionally comprising a third support coupled to one of said charge formers, said third support supporting a fuel delivery device.

13. The engine of claim 12, wherein said charge formers are positioned above one another, and said third support is attached to an upper charge former.

* * * * *